United States Patent [19]

Fio Rito et al.

[11] 4,339,999

[45] Jul. 20, 1982

[54] COMBINATION REFUSE PYROLYSIS AND MOISTURE REDUCTION APPARATUS

[76] Inventors: William M. Fio Rito, 12650 Mantilla Rd., San Diego, Calif. 92128; Ralph E. Kidd, 2042 Clark Ave., Long Beach, Calif. 90808

[21] Appl. No.: 263,069

[22] Filed: May 13, 1981

[51] Int. Cl.[3] ..... F23G 5/06

[52] U.S. Cl. ..... 110/226; 432/115; 432/103; 110/246

[58] Field of Search ..... 110/218, 224, 226, 246; 432/103, 105, 106, 111, 115

[56] References Cited

U.S. PATENT DOCUMENTS

| | | | |
|---|---|---|---|
| 1,459,302 | 6/1923 | Hermann | 110/226 |
| 1,491,894 | 4/1924 | Atkinson | 110/246 |
| 1,690,820 | 11/1928 | Hornsey | 432/115 |
| 2,020,682 | 11/1935 | Granger | 110/226 |
| 2,094,152 | 9/1937 | Granger | 110/246 |
| 2,151,320 | 3/1939 | Forni | 110/246 |
| 2,259,967 | 10/1941 | Vogel-Jorgensen | 110/226 |
| 3,751,199 | 8/1973 | Toft | 432/115 |
| 3,836,324 | 9/1974 | Shaefer et al. | 432/115 |

*Primary Examiner*—Henry C. Yuen

*Attorney, Agent, or Firm*—James E. Brunton

[57] ABSTRACT

An improved method and apparatus for pyrolyzing waste materials and recovering useful chemical and energy rich materials therefrom. The apparatus of the invention comprises a specially designed, rotatable pyrolysis chamber and a cooperating rotatable moisture reduction chamber which pretreats the refuse prior to its introduction into the pyrolysis chamber. The pyrolysis chamber and the moisture reduction chamber are uniquely interconnected so that a portion of the heat of combustion of the refuse is taken from the pyrolysis chamber and controllably introduced into the moisture reduction chamber to reduce the moisture content of the refuse which is continuously received therein. The outlet of the moisture reduction chamber is interconnected with the inlet of the pyrolysis chamber so that, in operation, the refuse received into the pyrolysis chamber is controllably pre-dried prior to pyrolysis. When the apparatus is at operating temperature, a portion of the combustible gases generated by the pyrolysis of the refuse is continuously mixed with air and the combustible gaseous mixture thus formed is used to sustain pyrolysis within the pyrolysis chamber.

7 Claims, 12 Drawing Figures

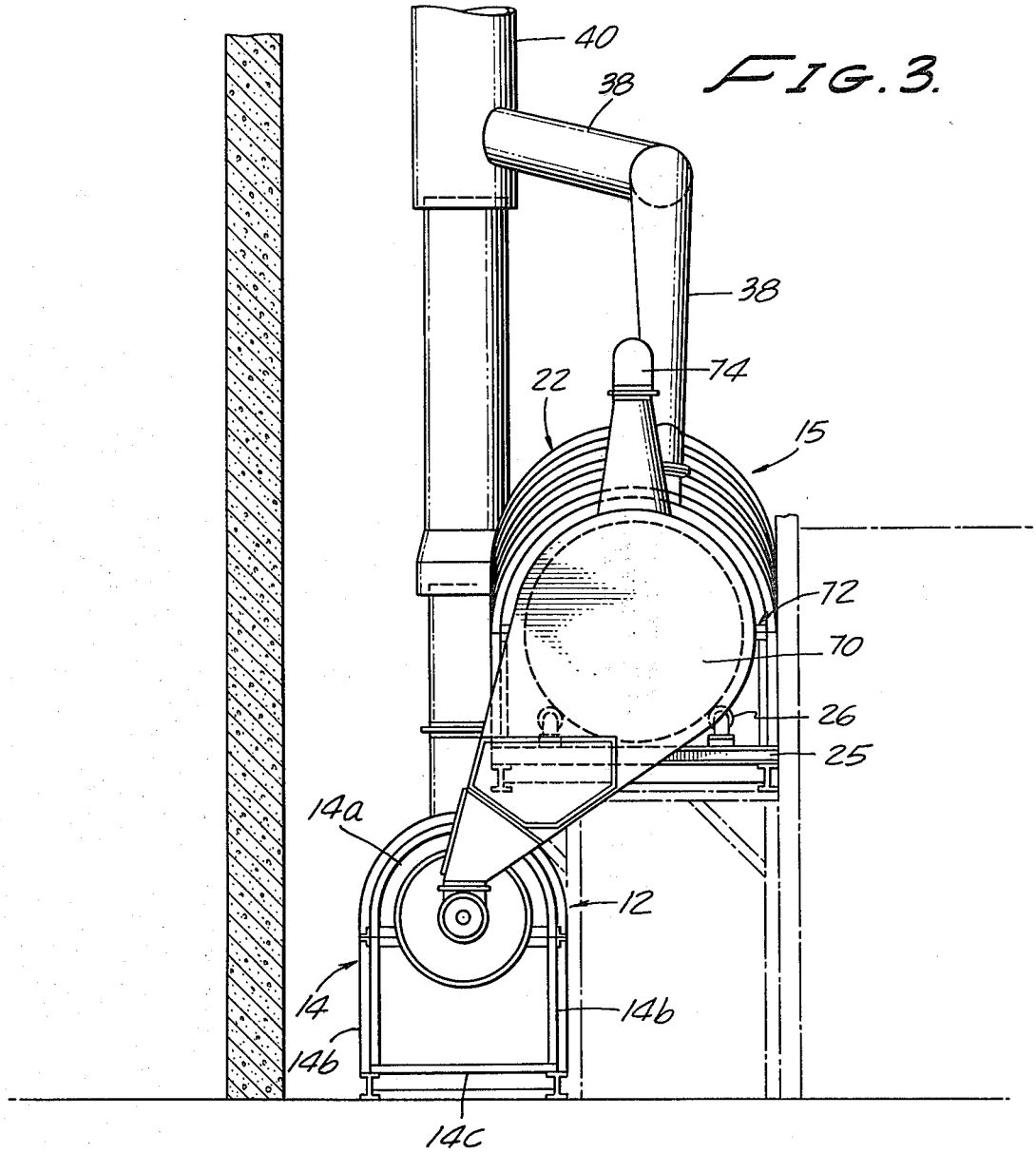
FIG. 3.
FIG. 8.
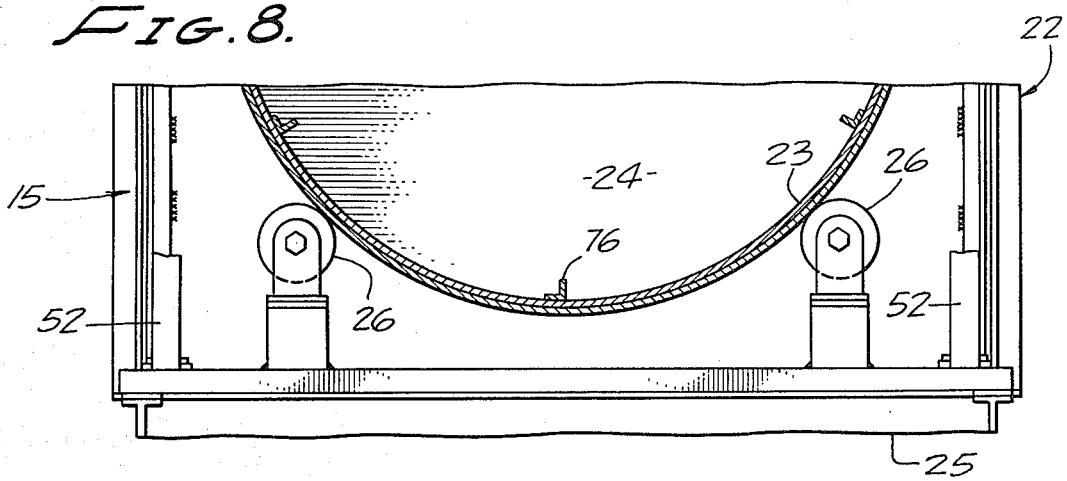

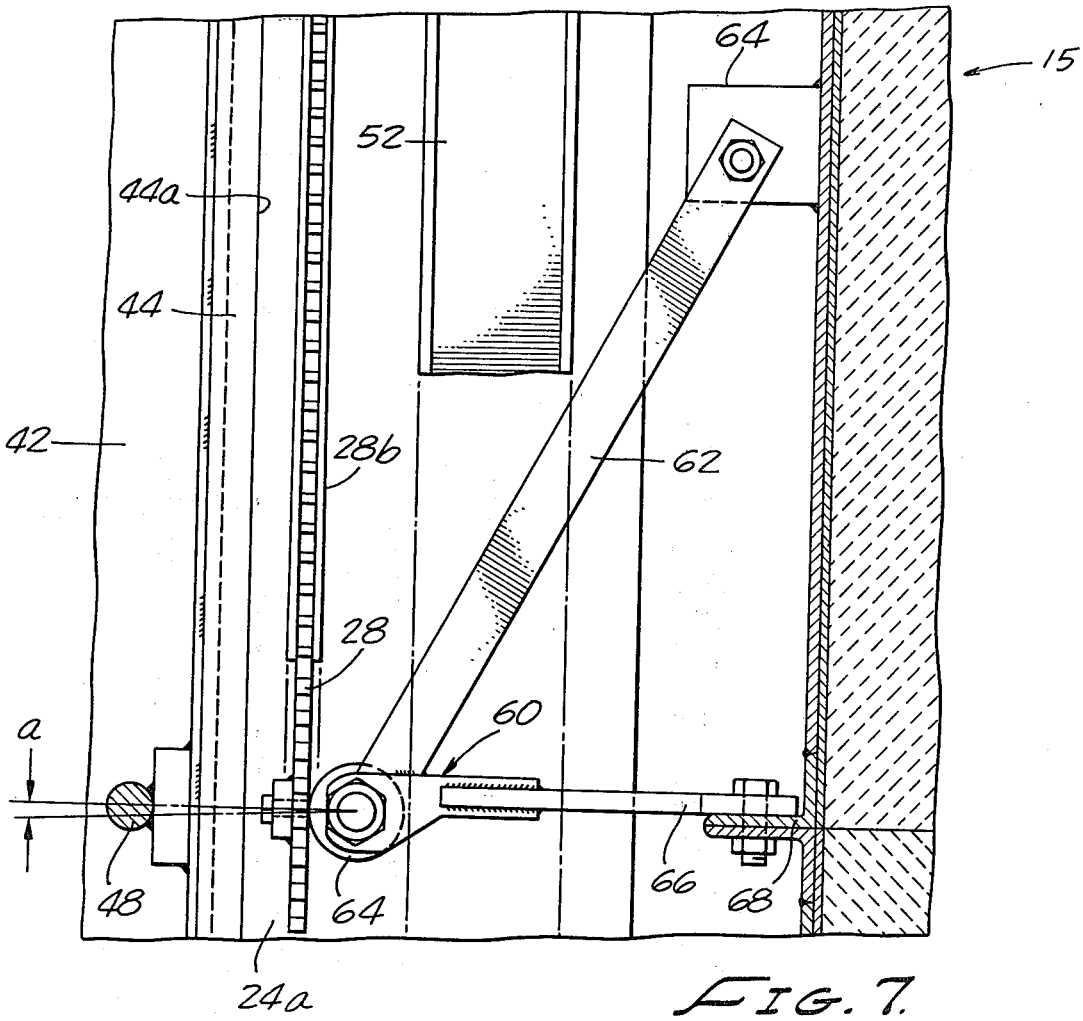
FIG. 7.
FIG 11
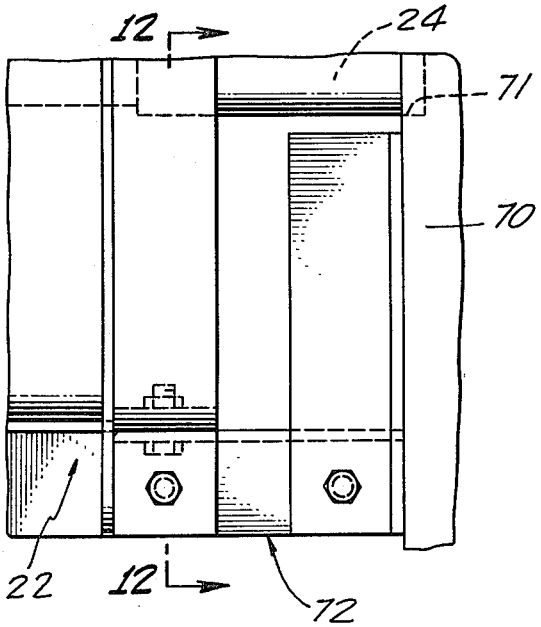
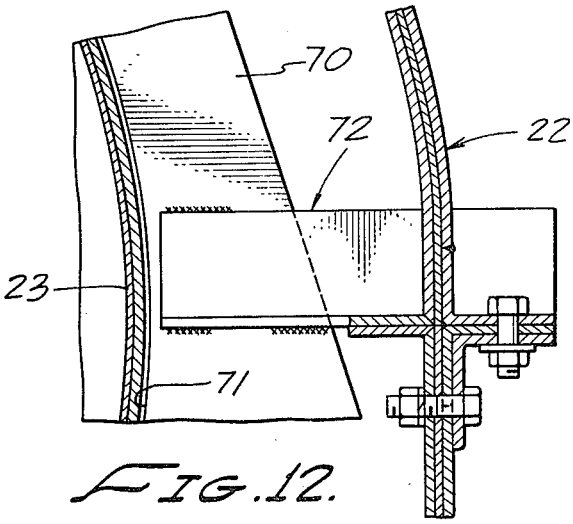
FIG. 12.

COMBINATION REFUSE PYROLYSIS AND MOISTURE REDUCTION APPARATUS

BACKGROUND OF THE INVENTION

1. Field of the Invention

The present invention relates generally to a method and apparatus for the self-sustaining pyrolysis of waste materials. More particularly, the invention relates to a novel continuous method and apparatus for controllably removing moisture from the waste material using a portion of the heat of combustion of waste materials being pyrolyzed with the pyrolysis portion of the apparatus. Once the apparatus is at operating temperature it becomes self-sustaining and will dry and subsequently pyrolyze the waste material without the need for an external source of fuel.

2. Discussion of the Prior Art

The search for new energy sources has become increasingly important due to the rapid rate of depletion of existing fossil fuels. One of the more promising sources of new energy is waste materials presently being discarded or destroyed. By techniques of pyrolytic decomposition, many types of waste materials can be converted into energy rich fuels such as combustible gases and char, or fuel carbon.

In the past, several types of devices for pyrolyzing refuse and other waste products have been suggested. Many of these devices have proved unworkable or economically unfeasible. Others, while feasible in concept have been proved to be inefficient and unreliable in continuous operation. Still others, while attractive in theory, have been shown to be too expensive to manufacture, install and operate.

Among the most successful prior art refuse conversion devices are the devices described in U.S. Pat. Nos. 2,886,122; 2,993,843; 3,020,212; 3,098,458; and 4,205,613. The present invention constitutes an improvement upon certain of the devices described in these patents.

As will become apparent from the description which follows, several important improvements to the apparatus described in the aforementioned patents have been made. One of the major improvements involves the provision of a cooperatively associated moisture reduction apparatus for controllably pre-drying the waste material prior to its introduction into the pyrolysis unit. By pre-treating the waste material prior to pyrolysis significantly greater pyrolysis efficiencies are obtained resulting in the production of substantial quantities of produced, or by-product gases which can be used not only to sustain the operation of the apparatus but also to provide excess fuel for operating auxilliary devices such as electrical generators and the like. Additionally, by pre-treating the waste materials the recovery of useful by-products such as char, metal and organic liquids is substantially enhanced.

One of the major drawbacks of prior art systems for the pyrolytic destruction of waste materials, including municipal refuse, concerns their inability to efficiently and consistently pyrolyse materials having widely varying moisture content. Depending upon weather conditions and a myriad of other factors the moisture content of the feed material may vary considerably. If the material to be pyrolyzed has too high a moisture content the pyrolysis may be incomplete or marginal thereby adversely affecting the production of by-product produced gas. Similarly waste having varying moisture content causes undesirable variations in the other by-product materials produced such as char by-products which may be subsequently activated or gasified.

The unique apparatus of the present invention solves the problems of prior art pyrolyzing devices by providing cooperating means for controllably pre-treating and pre-drying the waste materials to be introduced into the pyrolysis chamber.

As will become apparent from the paragraphs which follow, the novel apparatus of the present invention, due to its unique design, efficiently uses the surplus heat of combustion of the waste material to accomplish the waste pre-treatment. The pre-treatment chamber of the apparatus is uniquely arranged to prevent contamination and rotates within a housing, the interior of which is heated by the surplus heat from the pyrolysis chamber. The rotatable pre-treatment chamber is mounted above the pyrolysis unit and is inclined so that the transfer of the waste material through the system is economically accomplished by force of gravity. Unique positioning means locate the pre-treatment chamber and function to prevent axial movement of the chamber within its housing due to the inclination of its longitudinal axis of rotation.

Both the pre-treatment chamber and the pyrolysis chamber are provided with fixed waste inlet and outlet passageways and cooperate to prevent heat loss to preclude atmospheric contamination and to ensure complete and efficient pyrolysis.

SUMMARY OF THE INVENTION

It is an object of the present invention to provide an improved method and apparatus for pre-treating and then pyrolyzing waste material and recovering energy producing materials therefrom.

It is another object of the invention to provide a method and apparatus of the aforementioned character in which waste materials are efficiently and inexpensively pre-treated prior to pyrolization so as to continuously and precisely control the moisture content of the waste material being fed into the pyrolysis reactor.

It is another object of the invention to provide an improved apparatus as described in the preceding paragraphs which, once operating, is self-sustaining and requires no outside energy sources for either pre-treating or pyrolyzing the waste materials.

It is still another object of the invention to provide an apparatus of the character described in which the pre-treatment chamber is mounted above and is inclined with respect to the pyrolysis reactor so that the material flows through the apparatus by force of gravity.

Still another important feature of the invention concerns the provision of unique sealing means for sealably interconnecting the fixed inlet portion of the pre-treatment chamber housing with the pre-treatment chamber and the provision of unique positioning means for longitudinally positioning the pre-treatment chamber within its housing and for preventing movement of the chamber due to its inclined orientation.

Another novel feature of the invention concerns the unique manner in which the outlet of the rotating pre-treatment chamber is operably interconnected with the inlet of the rotating pyrolysis chamber.

The apparatus of the present invention, embodying the aforementioned improvements, for the first time enables the highly efficient, self-sustaining, continuous pre-drying and controlled pyrolysis of combustible materials under air tight conditions to economically produce highly useful chemical by-product materials as well as energy rich materials such as combustible gases and fuel carbon.

BRIEF DESCRIPTION OF THE DRAWINGS

FIG. 3 is an end view looking at the apparatus from the right end as viewed in FIG. 1.

FIG. 7 is a cross-sectional view taken along lines 7—7 of FIG. 6.

FIG. 8 is a fragmentary cross-sectional view taken along lines 8—8 of FIG. 5.

FIG. 11 is a greatly enlarged fragmentary view taken along lines 11—11 of FIG. 9.

FIG. 12 is a cross-sectional view taken along lines 12—12 of FIG. 11.

DESCRIPTION OF ONE FORM OF THE INVENTION

Figure 1:
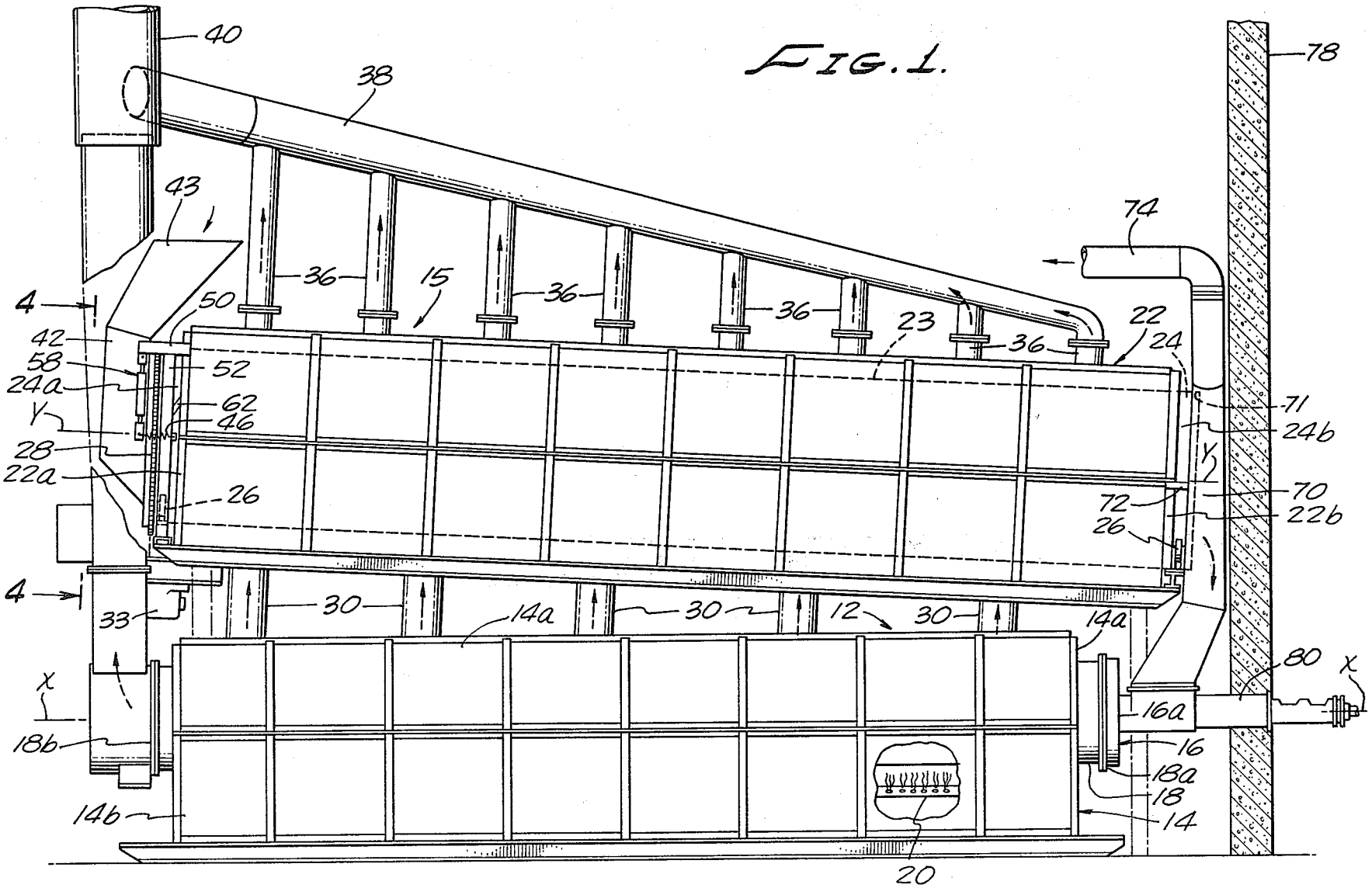
FIG. 1 is a side elevational view of the combination apparatus of the invention partly broken away to show internal construction.
Figure 2:
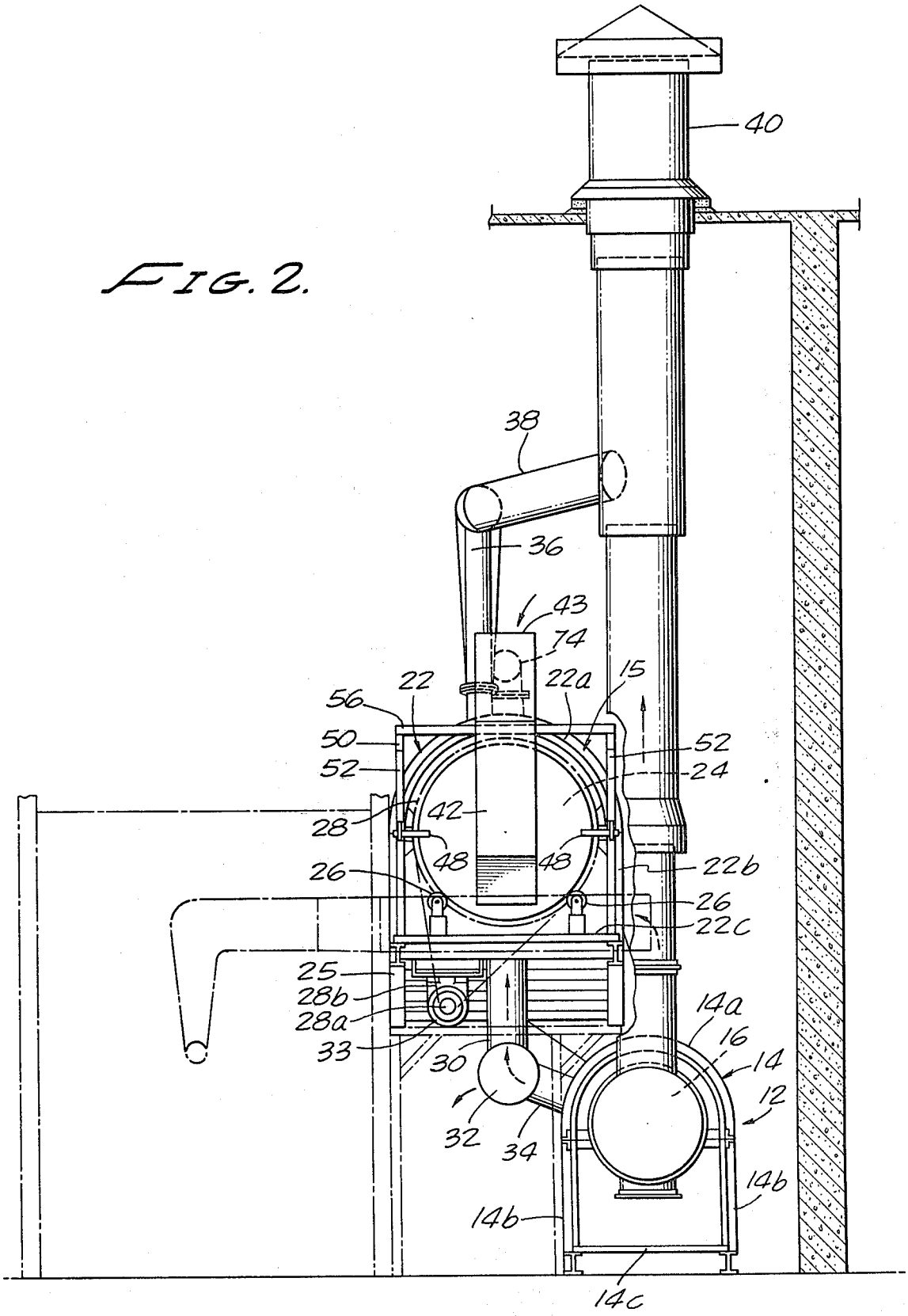
FIG. 2 is an end view looking at the apparatus from the left end as viewed in FIG. 1.

Referring to the drawings, and particularly to FIGS. 1 through 3, the apparatus of the present invention comprises two principal operating units, a waste pyrolysis unit, generally designated by the numeral 12, and a waste pre-treatment, or de-humidifying unit, generally designated by the numeral 15. The pyrolysis unit 12 comprises a first housing 14 and a combustion chamber 16, including a body portion 18 which is rotatably mounted within first housing 14 (FIG. 1). As best seen in FIG. 2, housing 14 has an insulated arcuate top portion 14*a* and interconnected insulated side and bottom walls 14*b* and 14*c* respectively. Although various types of insulation or refractory materials can be used to insulate the walls of housing 14, an outer lining of firebricks or the like coupled with an inner liner of high temperature insulation such as rockwool has proven quite satisfactory.

Combustion chamber 16, in which the waste material or refuse is pyrolyzed, comprises a rotatable tubular body portion 18 having first and second end portions 18*a* and 18*b*. As seen in FIG. 1, body portion 18 extends longitudinally of housing 14 with the end portions thereof protruding through first and second insulated walls 14*a* and 14*b*. End portions 18*a* and 18*b* of the combustion chamber are open and define respectively a material inlet and a material outlet for the reactor. The body portion 18 of the combustion chamber or pyrolysis retort, which is preferably of steel construction, may be rotatably supported by various means such as longitudinally spaced apart rollers or the like and is adapted to rotate about a longitudinal axis "X" (FIG. 1). The details of construction and operation of the pyrolysis retort are fully set forth in U.S. Pat. No. 4,205,613 issued to the present inventors.

Positioned beneath rotary combustion chamber 16 is a longitudinally extending burner system 20 which is adapted to controllably heat the rotating combustion chamber. As described in the previously identified U.S. Pat. No. 4,205,613, burner 20 may be fueled by either natural gas from an auxilliary source or from by-product gases produced from the combustion of the waste material within the combustion chamber.

Figure 10:
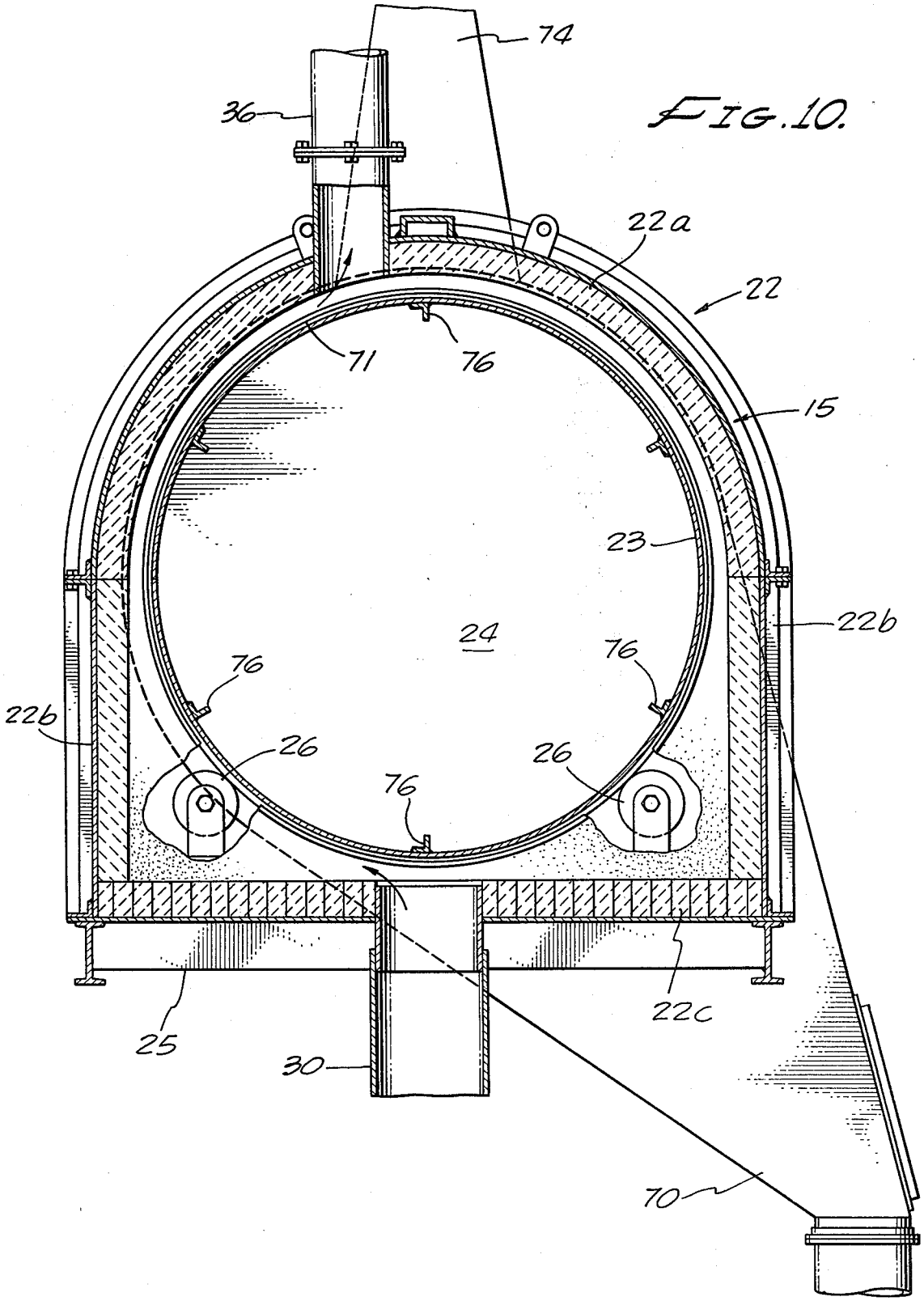
FIG. 10 is a cross-sectional view taken along lines 10—10 of FIG. 9.

The pre-treatment, or de-humidification unit 15 comprises a second housing 22 and a pre-treatment chamber 24 rotatably mounted within housing 22. Referring to FIGS. 2 and 10 housing 22 can also be seen to have an arcuately shaped insulated top wall 22*a* and interconnected insulated side and bottom walls 22*b* and 22*c* respectively. As indicated in FIG. 2, pre-treatment chamber 24 is supported by a structural framework 25 and comprises a rotatable tubular body 23 extending longitudinally of second housing 22 with the first and second end portions thereof 24*a* and 24*b* protruding through first and second insulated end walls 22*a* and 22*b* of housing 22 (FIG. 1). First end portion 24*a* of the pre-treatment chamber is open and defines a material inlet while second end portion 24*b* defines a material outlet.

Pre-treatment chamber 24 is rotatably supported proximate its ends by transversely spaced apart support rollers 26 carried at either end of the framework 25 which supports housing 22. The details of the construction and positioning of these rollers 26 is shown in FIGS. 8 and 10.

Figure 4:
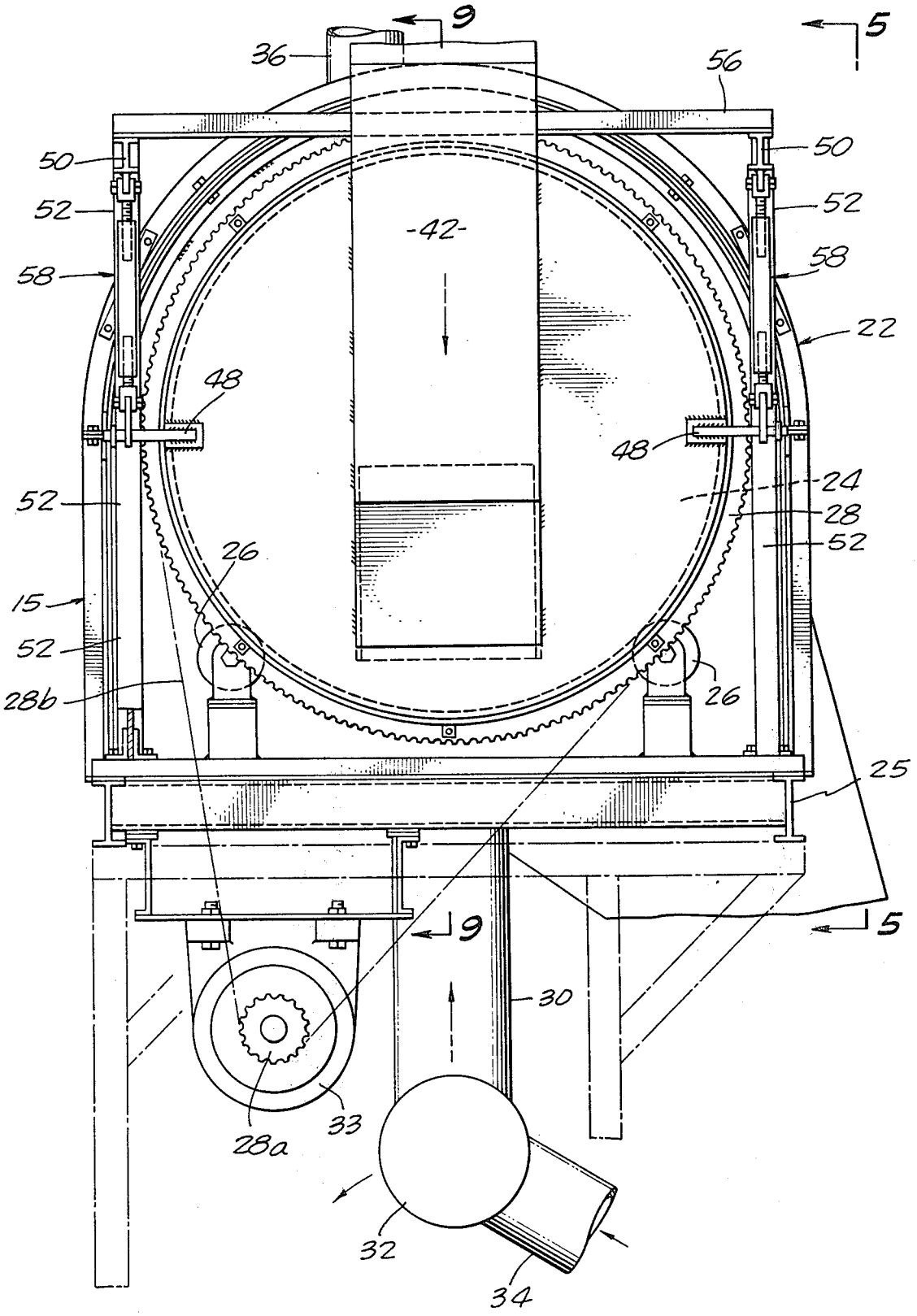
FIG. 4 is a greatly enlarged end view taken along lines 4—4 of FIG. 1.

A ring gear 28 is provided about the periphery of chamber 24 proximate its first, or inlet, end 24*a*. As best seen by referring to FIG. 4, ring gear 28 comprises the driven member portion of the drive means of the invention which means also includes a sprocketed drive member 20. As indicated in FIG. 4 drive member is adapted to drive the ring gear through a suitable belt or chain drive 28*b*. Drive sprocket 28*a* may in turn be driven by a variable speed motor 33 acting through a suitable drive train (not shown) the construction and operation of which is well understood by those skilled in the art. With this driving arrangement, the pre-treatment chamber can be driven at a controllable rate of speed which is optimum for the particular type of material being processed.

As indicated in FIG. 1, pre-treatment chamber 24 is adapted to be rotated by the drive means about an inclined axis "Y" which axis is disposed at an acute angle with respect to axis "X" about which the combustion chamber 18 rotates. This acute angle, which preferably should be no less than 3°, is designated by the letter "a" in FIGS. 7 and 9.

Referring to FIGS. 2 and 3, housing 22 can be seen to be disposed above and to one side of housing 14. Heat transfer means, shown here in the form of conduits 30 and 34, which are interconnected with a longitudinally extending manifold 32, operably interconnect the interior of first housing 14 with the interior of second housing 22 (see also FIGS. 4 and 10). As will be described in greater detail hereinafter, the purpose of this heat transfer means is to controllably transfer heat from the interior of housing 14*a* to the interior of housing 22*a* for purposes of controllably raising the temperature of the refuse, or waste materials, introduced into the rotating pre-treatment chamber 24. Referring also to FIGS. 1 and 10, it can be seen that the heat introduced into housing 22 is vented therefrom to atmosphere through a plurality of venting conduits 36 protruding from the upper arcuate surface of housing 22. Each of the conduits 36 is is interconnected with a longitudinally extending conduit 38 which in turn is interconnected with a vent stack 40 adapted to be vented to atmosphere.

Figure 9:
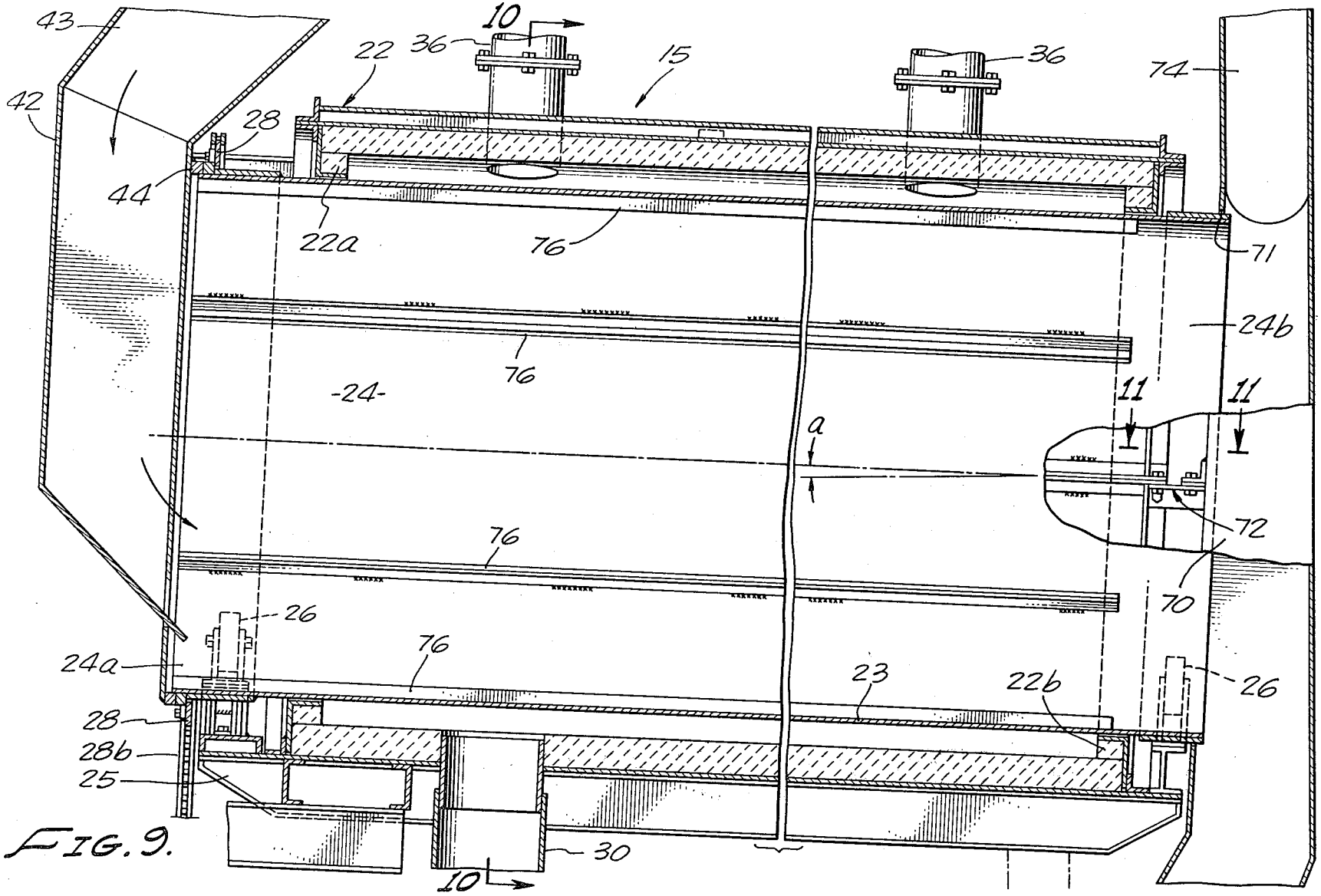
FIG. 9 is a foreshortened longitudinal cross-sectional view taken along lines 9—9 of FIG. 4.

Turning now to FIGS. 1 and 9 there is provided a first fixed material receiving means, including material inlet duct 42, which is carried by a supporting assemblage affixed to second housing 22 proximate its upper or first end 22*a*. Duct 42 includes an upper inlet portion 43 into which the material to be treated is introduced.

Figure 5:
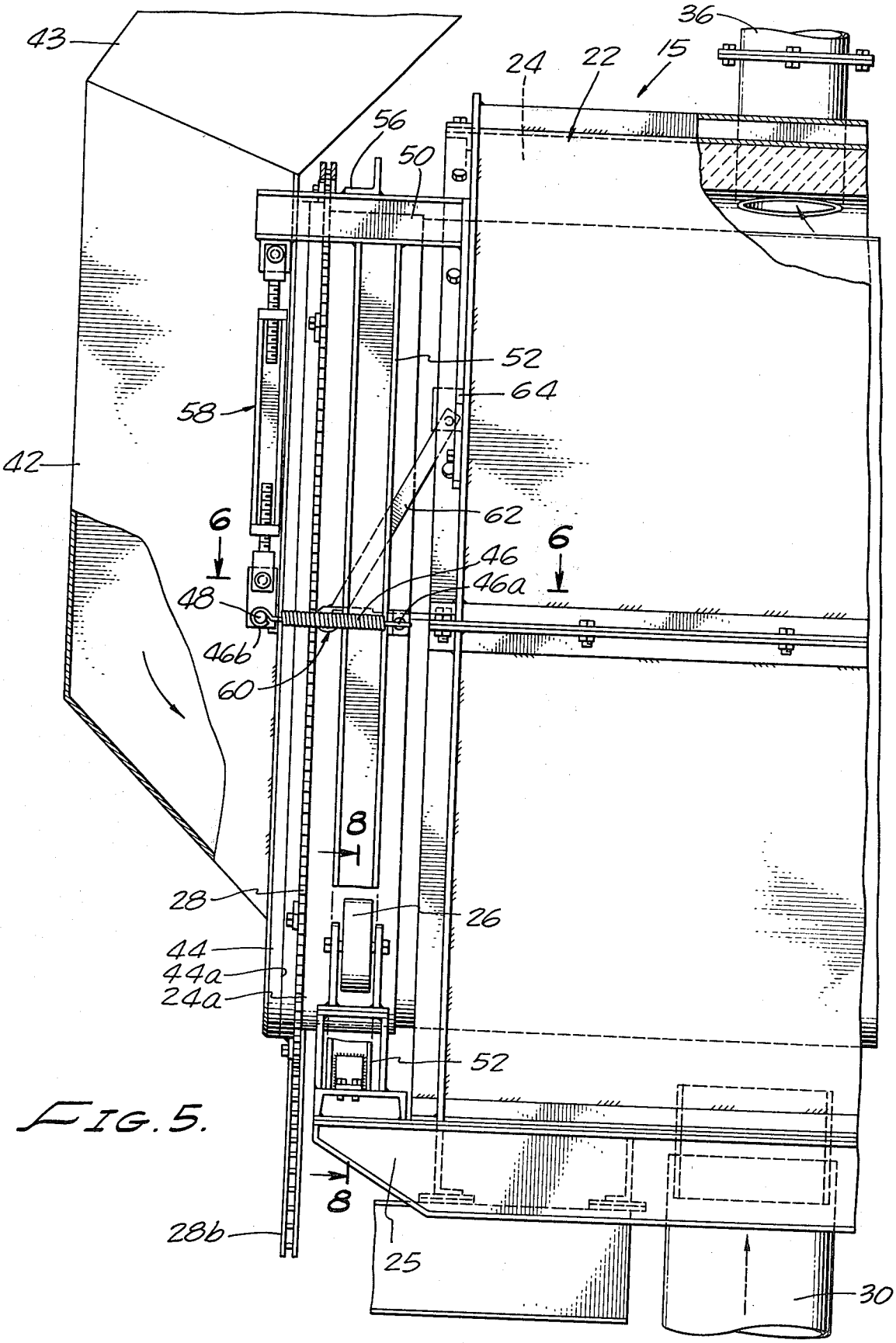
FIG. 5 is a side elevational view, partly broken away to show internal construction taken along lines 5—5 of FIG. 4.
Figure 6:
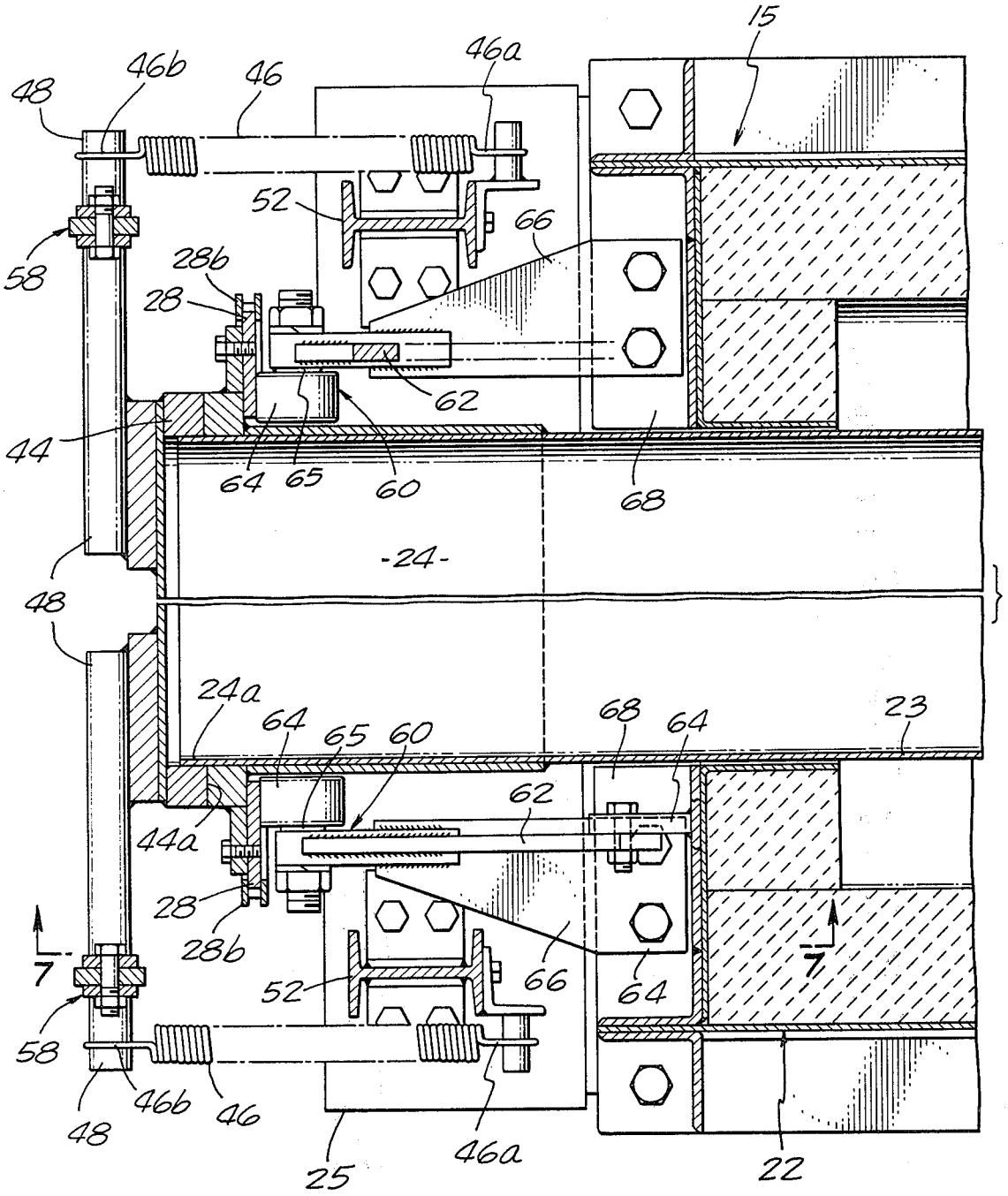
FIG. 6 is a cross-sectional view taken along lines 6—6 of FIG. 5.

The fixed material receiving means of the present form of the invention also includes a first sealing means for sealably interconnecting the material inlet duct with the material inlet, or first end, 24*a* of pre-treatment chamber 24. As best seen by referring to FIG. 5, in the form of the present invention thereshown, this sealing means comprises an end plate 44 having an annular shaped surface 44*a* adapted to sealably engage the first end 24*a* of the pre-treatment chamber. End plate 44, which is operably associated with material inlet duct 42, is provided with a central opening adapted to communicate with the material inlet of the pre-treatment chamber 24. The sealing means also includes biasing means for urging the annular surface of the end plate 44 into sealable engagement with the first end 24*a* of the pre-treatment chamber 24. As illustrated in FIGS. 4, 5 and 6, in the present embodiment of the invention, the baising means is provided in the form of a pair of transversely spaced apart coil springs 46. Each spring 46 is connected at one of its ends 46*a* to the framework of housing 22 and at its opposite end 46*b* to a radially outwardly extending rod 48 affixed to each side of end plate 44 (FIG. 4). With this arrangement, the springs 46 continuously urge the rods 48 and in turn end plate 44 into sealable engagement with the first end 24*a* of the pre-treatment chamber.

The apparatus of the present invention also includes mounting means carried by second housing 22 for adjustably supporting end plate 44 and the material receiving duct 42 which is connected thereto. In the present embodiment of the invention, the mounting means comprises a pair of forwardly extending members 50 supported proximate their mid points by a pair of substantially vertically extending members 52, the lower ends of which are affixed to and supported by framework 25 (FIG. 5). A transversely extending member 56 interconnects members 50 intermediate their end portions and adds structural support to the supporting assemblage. Depending from the outboard ends of each member 50 is a turnbuckle assembly 58, the lower end of which is interconnected with the previously identified transversely extending rods 48 which are affixed to end plates 44. With this arrangement, by adjusting turnbuckles 58, end plate 44 may be raised or lowered with respect to pre-treatment chamber 24 to enable precise centering of the annular sealing surface on plate 44 with the first end portion 24*a* of the pre-treatment chamber.

Due to the fact that the axis of rotation of the pre-treatment chamber is inclined with respect to horizontal, it is necessary to provide means for restraining axial movement of the pre-treatment chamber within the housing 22 as the chamber is rotated by the drive means. In the present embodiment of the invention this means is provided in the form of a pair of roller assemblies 60 provided on either side of pre-treatment chamber 24. Referring particularly to FIGS. 6 and 7, these roller assemblies 60 can be seen to comprise an angularly downwardly extending member 62 affixed at its upper end to a bracket 64 which is rigidly connected to the framework of housing 22. Rotatably mounted on stub axels 65 carried at the lower end of each of the members 62 is a roller 60 which is held in rolling engagement with the rear surface of ring gear 28 by means of a substantially horizontally extending support member 66, the inboard or right end of which, as viewed in FIG. 7, is connected to a bracket 68 which is in turn rigidly affixed to the framework of housing 22. With this arrangement as the pre-treatment chamber rotates, rollers 64 will continuously engage and roll against the rear surface of ring gear 28 thereby preventing any longitudinal movement of the pre-treatment chamber rearwardly or to the right as viewed in FIGS. 1 and 7.

Turning now to FIGS. 9, 11 and 12, it can be seen that there is provided at the right, or lower end of the rotating pre-treatment chamber 24, a fixed, non-rotatable material transfer duct 70 which is in communication with the material outlet 24*b* of the pre-treatment chamber and is also in communication with the material inlet 18*a* of the combustion chamber. This material transfer duct 70 functions to continuously transfer the treated waste material from the pre-treatment chamber into the rotating combustion or pyrolysis chamber of the combustion unit. To prevent heat loss and to preclude escape of any particulate material from the system, the lower or second end portion 22*b* of the pre-treatment chamber extends into material duct 70 a substantial distance through a circular opening 71 provided therein. The opening 71 in duct 70 closely approximates the outside diameter of the material treatment chamber and, as shown in FIGS. 11 and 12, is held in precise alignment with the pre-treatment chamber by means of an assemblage of brackets 72 which rigidly interconnect duct 70 with the framework of housing 24.

The upper portion 74 of duct 70 comprises a vent means adapted to suitably vent gases emanating from the treated waste material as it leaves the pre-treatment chamber.

OPERATION

At steady state operating conditions, waste material, such as municipal refuse, is introduced into the apparatus through portions 43 of duct 42. Depending upon the nature of the waste material being processed, the material may be shreaded or otherwise treated prior to its introduction into the apparatus.

Because the pre-treatment chamber 24 is inclined, the waste material introduced through duct 42 will travel at a uniform rate of speed through the pre-treatment chamber 24 toward the outlet end 24*b* thereof (FIG. 1). As shown in FIG. 10, inwardly protruding members, or flights 76 extend longitudinally of chamber 24. These members encourage agitation of the waste to promote its uniform exposure to heat being transferred from the pyrolysis chamber to the pre-treatment chamber through ducts 30.

As the waste material travels through the pre-treatment chamber 24 it is controllably de-humidified and optimized for pyrolysis. The speed of rotation of the pre-treatment chamber, the design of the internal flights 76 and the angle of inclination of the chamber governs the rate of travel of the waste through the pre-treatment chamber. In a manner presently to be described, the transfer of heat from the pyrolysis chamber to the housing surrounding the pre-treatment chamber can also be controlled to optimize the de-humidification of the particular waste material being processed.

The unique design of the end plate adjustment assemblage and sealing means disposed at the inlet end of the pre-treatment chamber and of the material transfer duct at the outlet end thereof minimize heat loss, atmospheric contamination and material spillage.

Turning to FIG. 1 it can be seen that the apparatus of the invention is positioned on the left hand side of a partition or wall 78 to isolate it from other operational equipment and facilities. Extending through the wall 78, however, is a tubular member 80 leading to the combustion chamber or retort. This member 80 is adapted to house a feed means such as an auger or feed piston (not shown) for force feeding into the reactor the pre-treated material coming from the pre-treatment chamber by way of the material transfer duct 70.

As described in U.S. Pat. No. 4,205,613, during start-up, combustible gas, such as natural gas, is burned in the burners 20 to bring the retort up to operating temperature. Once at operating temperature, however, the gases produced from the pyrolysis of the waste materials are supplied to the burners 20 and are more than sufficient to sustain the pyrolysis.

As the combustion chamber 18 reaches its normal operating temperature of on the order of 1200° F., the air within housing 14 is heated and, by means of conduits 30, is transferred to the interior of housing 22 of the material pre-treatment unit. Conduits 30 are stratigically placed along the length of the pre-treatment chamber so as to continuously and uniformly heat the chamber and the waste material contained therein. By controlling the rate of travel of the waste material through the pre-treatment chamber and by controlling the heat transfer from the pyrolysis unit, the waste material can be precisely and accurately de-humidified to the degree necessary to optimize pyrolysis and the production of by product materials such as char and organic liquids which may be recovered at the outlet end **18*b*** of the combustion chamber.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. An apparatus for pre-treating and then controllably pyrolyzing waste materials and recovering useful energy producing materials and chemical by-products therefrom, comprising:

(a) a first housing;

(b) a combustion chamber including a body portion mounted within said housing and adapted for rotation about a first longitudinally extending axis, said body portion having a material inlet and a material outlet;

(c) burner means for controllably heating the interior of said first housing and said body portion of said combustion chamber;

(d) a second housing mounted above said first housing;

(e) a pre-treatment chamber adapted for rotation within said second housing about a second longitudinally extending axis, said pre-treatment chamber having a first end provided with a material inlet and a second end provided with a material outlet, said material outlet being operably interconnected with said material inlet of said body portion;

(f) heat transfer means interconnecting said interior of said first housing and said interior of said second housing for controllably transferring heat therebetween;

(g) a first fixed material receiving means disposed proximate the first end of said pre-treatment chamber, said means including a material inlet duct in communication with said material inlet of said rotatable pre-treatment chamber and further including first sealing means for sealably interconnecting said material inlet duct and said material inlet of said pre-treatment chamber;

(h) a fixed material transfer duct disposed proximate said second end of said rotatable pre-treatment chamber said transfer duct being in communication with said material outlet of said rotatable pre-treatment chamber and also being in communication with said material inlet of said combustion chamber; and (i) said first sealing means includes an end plate adapted to sealably engage said first end of said pre-treatment chamber, said first end plate having a central opening therein adapted to communicate with said material inlet of said pre-treatment chamber and said first sealing means further includes biasing means for continuously urging said end plate into sealable contact with said first end of said pre-treatment chamber.

2. An apparatus as defined in claim 1 in which an angle between the axis of rotation of said body portion of said combustionn chamber and the axis of rotation of said pre-treatment chamber is at least 3 degrees.

3. An apparatus as defined in claim 2 including means carried by said second housing for resisting axial movement of said pre-treatment chamber relative to said second housing.

4. An apparatus for pre-treating and then controllably pyrolyzing waste materials and recovering useful energy producing materials and chemical by-products therefrom, comprising:

(a) a first housing;

(b) a combustion chamber including a tubular shaped body portion mounted within said housing and adapted for rotation about a first longitudinally extending axis, said body portion having a material inlet and a material outlet;

(c) a burner means for controllably heating the interior of said first housing and said body portion;

(d) a second housing mounted above said first housing;

(e) a tubular shaped pre-treatment chamber adapted for rotation within said second housing about a second longitudinally extending axis disposed at an acute angle with respect to the axis of rotation of said body portion of said combustion chamber, said pre-treatment chamber having a first end provided with a material inlet and a second end provided with a material outlet, said material inlet being elevated relative to said material outlet;

(f) a fixed material receiving means carried by said second housing proximate the first end of said pre-treatment chamber and including a non-rotatable material inlet duct and sealing means for sealably engaging said first end of said pre-treatment chamber, said sealing means including:

(1) an end plate having an annular shaped surface adapted to sealably engage said first end of said pre-treatment chamber, said end plate having a central opening therein adapted to communicate with said material inlet of said pre-treatment chamber; and (2) biasing means for urging said annular surface of said end plate into sealable engagement with said first end of said pre-treatment chamber;

(g) a fixed material transfer means carried by said second housing proximate the second end of said pre-treatment chamber for transferring material between said material outlet of said pre-treatment chamber and said material inlet of said combustion chamber;

(h) means carried by said second housing for restraining axial movement of said pre-treatment chamber within said housing; and (i) heat transfer means interconnecting said interior of said first housing and said interior of said second housing for controllably transferring heat therebetween, said heat transfer means comprising at least one conduit interconnecting said first and second housings.

5. An apparatus as defined in claim 4 including mounting means carried by said second housing for supporting said fixed material inlet means, said mounting means including adjustment means for adjusting the position of said end plate with respect to said first end of said pre-treatment chamber.

6. An apparatus as defined in claim 4 including drive means for rotating said pre-treatment chamber, said drive means including a driving member adapted to drive a driven member affixed to and extending radially outwardly from said pre-treatment chamber.

7. An apparatus as defined in claim 5 in which said means for restraining axial movement of said pre-treatment chamber comprises at least one roller member carried by said second housing and adapted to rollably engage said driven member.

* * * * *